US007195426B2

(12) United States Patent
May

(10) Patent No.: US 7,195,426 B2
(45) Date of Patent: Mar. 27, 2007

(54) STRUCTURAL PIER AND METHOD FOR INSTALLING THE SAME

(76) Inventor: Donald May, 25662 S. Brentwood Dr., Sun Lakes, AZ (US) 85248

( * ) Notice: Subject to any disclaimer, the term of this patent is extended or adjusted under 35 U.S.C. 154(b) by 0 days.

(21) Appl. No.: 11/136,315

(22) Filed: May 24, 2005

(65) Prior Publication Data

US 2006/0269364 A1 Nov. 30, 2006

(51) Int. Cl.
*E02D 5/00* (2006.01)

(52) U.S. Cl. ..... 405/230; 405/229

(58) Field of Classification Search ..... 405/230, 405/229, 231, 232

See application file for complete search history.

(56) References Cited

U.S. PATENT DOCUMENTS

| | | | | |
|---|---|---|---|---|
| 2,465,557 | A | 3/1949 | Thornley | |
| 4,070,867 | A | 1/1978 | Cassidy | |
| 4,538,938 | A | 9/1985 | Grzelka et al. | |
| 4,634,319 | A | 1/1987 | May | |
| 4,667,746 | A | 5/1987 | Moraly | |
| 4,673,315 | A | 6/1987 | Shaw et al. | |
| 4,678,373 | A | 7/1987 | Langenbach, Jr. | |
| 4,708,528 | A | 11/1987 | Rippe | |
| 4,733,994 | A | 3/1988 | Simanjuntak | |
| 4,800,700 | A | 1/1989 | May | |
| 4,854,782 | A | 8/1989 | May | |
| 4,925,345 | A | 5/1990 | McCown et al. | |
| 5,011,336 | A | 4/1991 | Hamilton et al. | |
| 5,013,190 | A | 5/1991 | Green | |
| 5,123,209 | A | 6/1992 | Nally | |
| 5,154,539 | A | 10/1992 | McCown et al. | |
| 5,171,107 | A | 12/1992 | Hamilton et al. | |
| 5,205,673 | A | 4/1993 | Bolin et al. | |
| 5,213,448 | A | 5/1993 | Seider et al. | |
| 5,234,287 | A | 8/1993 | Rippe, Jr. | |
| 5,246,311 | A | 9/1993 | West et al. | |
| 5,253,958 | A | 10/1993 | Bellemare | |
| 5,288,175 | A | 2/1994 | Knight | |
| 5,310,287 | A | 5/1994 | Arentsen | |
| 5,336,021 | A | 8/1994 | Freeman, III | |
| 5,482,407 | A * | 1/1996 | Raaf | 405/230 |
| 5,492,437 | A | 2/1996 | Ortiz | |
| 5,658,099 | A | 8/1997 | Pienaar et al. | |
| 5,800,094 | A | 9/1998 | Jones | |
| 5,980,162 | A | 11/1999 | McCown | |
| 6,074,133 | A | 6/2000 | Kelsey | |
| 6,079,905 | A | 6/2000 | Ruiz et al. | |
| 6,193,442 | B1 | 2/2001 | May | |
| 6,247,875 | B1 | 6/2001 | Schmednecht et al. | |
| 6,352,390 | B1 * | 3/2002 | Jones | 405/230 |
| 6,368,022 | B1 | 4/2002 | Zingerman | |
| 6,368,023 | B1 | 4/2002 | Lau | |
| 6,468,002 | B1 * | 10/2002 | Gregory et al. | 405/230 |
| 6,539,685 | B2 * | 4/2003 | Bell et al. | 405/230 |
| 6,659,692 | B1 | 12/2003 | May | |
| 6,840,714 | B1 * | 1/2005 | Vache | 405/230 |

* cited by examiner

*Primary Examiner*—Frederick L. Lagman
(74) *Attorney, Agent, or Firm*—Steptoe & Johnson LLP; Tyson Y. Winarski

(57) ABSTRACT

The present invention is for a pier that supports a foundation. The pier includes a pier shaft, a bracket mounted to a top end of the pier shaft that supports the weight of the foundation, and a pair of braces that extend laterally from the pier shaft and mount to the foundation.

19 Claims, 4 Drawing Sheets

STRUCTURAL PIER AND METHOD FOR INSTALLING THE SAME

FIELD OF THE INVENTION

The present invention relates to the field of structural devices used to support the foundation of a commercial or residential building.

BACKGROUND OF THE INVENTION

Many structures, such as residential homes and low rise buildings, are constructed on foundations that are not in direct contact with a stable load bearing underground stratum, such as, for example, bedrock. These foundations are typically concrete slabs or a footing upon which a foundation wall rests. The footing is generally wider than the foundation wall in order to distribute the structure's weight over a greater surface area of load bearing earth. Therefore, the stability of these structures depends upon the stability of the ground underneath or supporting the foundation. With time, the stability of the underlying soil may change for many reasons, such as changes in the water table, soil compaction, ground movement, or the like. When the stability of the support ground changes, many times the foundation will move or settle. The settling of a structure's foundation can cause structural damage reducing the value of the structure or total property.

For instance, structural settling can cause cracks in foundation walls, as well as unsightly cracks in the interior or exterior of building walls and floors. In addition, settling can shift the structure causing windows and doors to open and close properly. Inventors have recognized the foundation-settling problem and have developed various devices and methods to correct its effects.

One common device and method to correct foundation settling consists of employing hydraulic jacks in conjunction with piers to lift the foundation. Piers, also known as piles or pilings, are driven into the ground by hydraulic mechanisms until the pier reaches bedrock or until the pier's frictional resistance equals the compression weight of the structure. Once these piers are secured in a stable underground stratum or several stable underground strata, further lifting by the hydraulic jacks raises the level of the foundation. When the foundation is raised to the desired level, the piers are permanently secured to the foundation. The hydraulic jacks are then removed. This method of correcting the level of a foundation generally requires the excavation of a hole adjacent to or underneath the foundation in order to position and operate the lifting equipment.

Steel piers are well known and exist in many varieties. One common type of a pier is a straight steel pier that is driven down until it reaches bedrock or stable soil weight bearing layer. These straight steel piers are rammed straight down into the ground. Another style of pier known to the art is a helical pier. On the end of a long pier shaft is a large helix. This helix distributes the weight of the pier over a larger surface area of soil making it a highly desirable pier structure to use. Unlike straight piers that are driven straight through the earth, it is necessary to screw the helical piers into the earth by rotating the pier shaft.

Steel piers currently known in the art are predominantly directed toward only addressing the problem of settling, that is the downward movement of the structure due to various environmental conditions, which are primarily hydro-geologic in nature. These steel piers that are designed to only address settling problems have an extremely high level of mechanical stability when supporting the downward load of the building foundation. However, these steel piers are generally not configured to remain stable under a sheer condition where the building moves laterally with respect to the pier and surrounding earth. Further, these piers are generally not configured to remain engaged to and support a building when the surrounding earth rises and pushes the building upward.

During the lifespan of a building, the building foundation may experience more than just the downward movement caused by settling. In a seismic event, the earth can move vertically, called uplift, as well as laterally. Other geologic phenomena such as landslides, or mudslides (common in southern California) can also produce lateral movement of ground supporting a building foundation. Buildings supported by steel piers configured to address only settling commonly fail when the surrounding earth undergoes lateral or vertical movement, resulting in serious damage or complete loss of the supported building. Consequently, there is a very distinct need in the art to develop an improved pier design that can support a building under lateral and vertical ground movements as well as settling.

SUMMARY OF THE INVENTION

The present invention is for a pier that supports a foundation. The pier includes a pier shaft, a bracket mounted to a top end of the pier shaft that supports the weight of the foundation, and a pair of braces that extend laterally from the pier shaft and mount to the foundation. These braces increase the structural integrity of the pier.

DETAILED DESCRIPTION OF A PREFERRED EMBODIMENT

Figure 1:
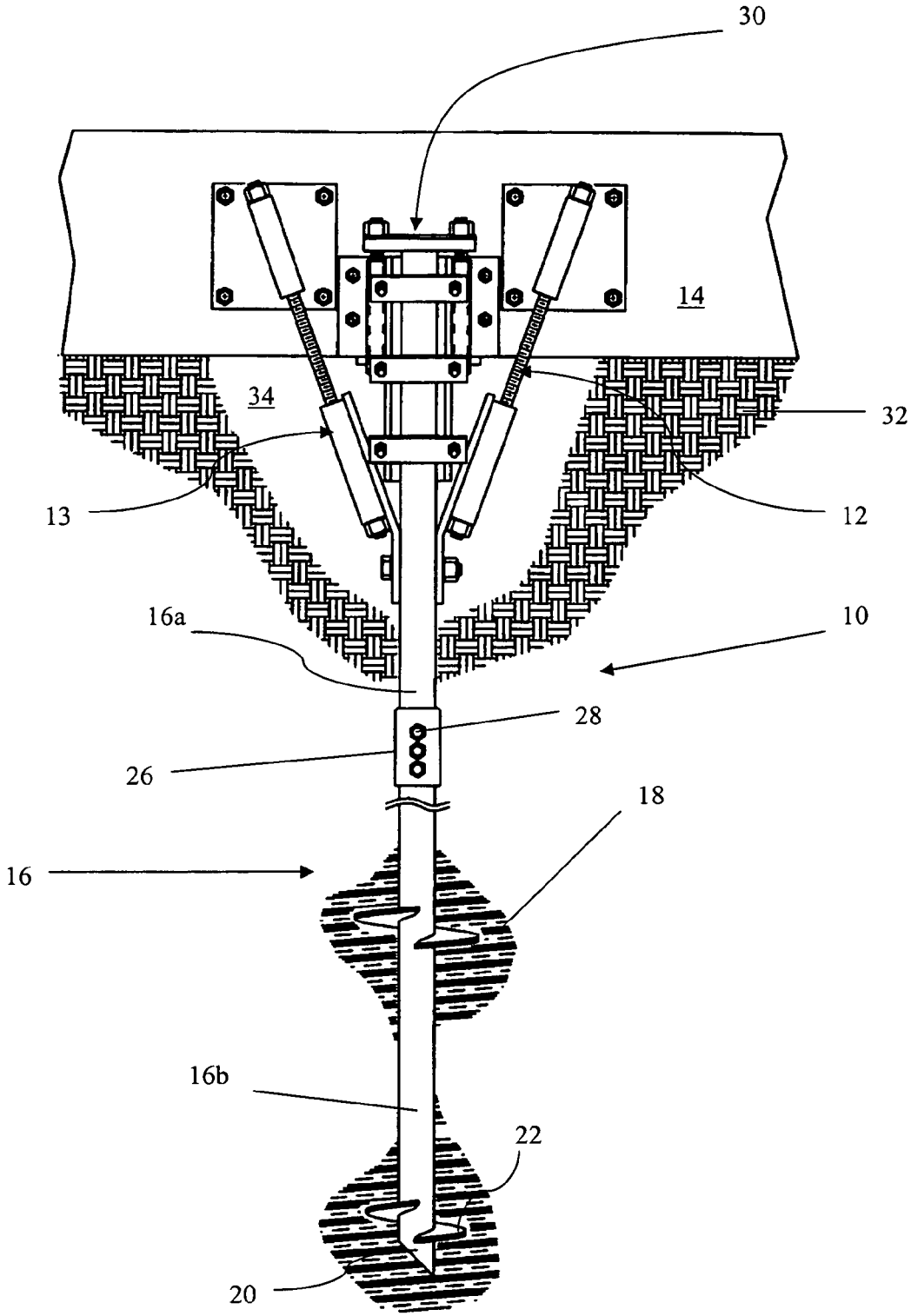
FIG. 1 depicts a front view of a pier assembly having braces supporting a building foundation.

Referring to the drawings by figures of reference, FIG. 1 depicts a front view of a pier assembly 10 having braces 12 and 13 supporting a building foundation 14. Pier assembly 10 includes a pier shaft 16 that is driven into a stable weight baring stratum of earth 18, such as bedrock. Pier shaft 16, shown collectively as 16*a* and 16*b*, is provided with a bottom end 20. Helical screws 22 are mounted to the side of pier shaft 16, thereby making pier shaft 16 a "helical" pier. Pier shaft 16 is driven into the earth by means of a torque motor that rotates pier shaft 16, which is then pulled down through the earth by means of helical screws 22.

In order to reach a weight baring stratum 18, pier assembly 10 may be formed from several lengths of pier shaft. In FIG. 1, two lengths of pier shaft 16*a* and 16*b* are illustrated to form pier shaft 16. These lengths of pier shaft 16*a* and 16*b* are joined together by a collar 26 that extends over the joint between the coupled pier shafts 16*a* and 16*b*. In FIG. 1, collar 26 is bolted to pier shaft 16*a* and 16*b* by bolts 28. However, the use of bolts 28 is merely exemplary. Other methods of mechanically attaching sections of pier shaft 16*a* and 16*b* together with collar 26 are well known and exist in many varieties, such as welding or adhesive bonding. The use of two lengths of pier shaft 16*a* and 16*b* is merely exemplary. The depth of weight baring stratum 18 and the physical length of each pier shaft 16*a* and 16*b* dictates the number of pier shaft lengths 16*a* and 16*b* that are used to form pier assembly 10.

Pier shaft 16 is anchored to building foundation 14 by bracket 30 and braces 12 and 13. Bracket 30 transfers the load of building foundation 14 onto pier shafts 16*a* and 16*b*. Braces 12 and 13 function to anchor pier assembly 10 to building foundation 14. Building foundation 14 rests on earth ground 32, which is typically formed of compacted soil. Over time, ground 32 may erode, subside, or collapse into a sink hole as a result of environmental changes, such as changes to the water table. As a result of these changing conditions of ground 32, building foundation 14 may settle and threaten to cause damage to the rest of the building. Bracket 30 and pier shafts 16*a* and 16*b* combine to form a pier assembly that supports building foundation 14 and protects it against settling. Bracket 30 and pier shafts 16*a* and 16*b* form a stable mechanical structure to support the downward load of building foundation 14. However, during its lifespan, building foundation 14 may be placed in other stress conditions to types of ground 32 changes that are different from settling.

In addition to settling, ground 32 may shift laterally or move vertically. Typically, ground 32 moves laterally or vertically during a seismic event. Other geologic phenomena such as landslides, or mudslides, common in southern California, can also produce lateral movement of ground 32. Vertical movement of ground 32 is commonly referred to as "uplift." If pier assembly 10 were comprised of pier shafts 16*a* and 16*b* and bracket 30 only and did not include braces 12 and 13, lateral or vertical movement of ground 32 could displace the top portion of pier shaft 16*a* relative to the base of pier shaft 16*b*, thereby preventing pier shaft 16 from bearing the load of building foundation 14. This mechanical failure would result in serious damage if not complete destruction of the building supported by building foundation 14. Braces 12 and 13 are provided to mitigate this type of damage by enabling pier assembly 10 to continue to support the load of building foundation 14 under conditions of vertical or lateral ground 32 movement. Braces 12 and 13 provide additional means of anchoring pier shaft 16 to building foundation 14. In addition, braces 12 and 13 strengthen the coupling of pier assembly 10 to foundation 14 in both the lateral and vertical directions.

Pier assembly 10 is preferably attached to foundation 14 in the following general manner. A hole 34 is excavated adjacent to building foundation 14. While FIG. 1 illustrates only one hole 34, in an actual building installation, numerous holes 34 would be excavated along the perimeter to accommodate the installation of numerous pier assemblies 10. Pier shaft 16*b* bearing helical screws 22 is then rotationally driven down into ground 32 with a motor until it reaches a stable load bearing stratum of earth 18. If pier shaft 16*b* does not have a length sufficient to reach load baring stratum 18, an additional length of pier shaft 16*a* is attached to pier shaft 16*b* by means of collar 26 and bolts 28. Combined pier shaft 16 is then rotationally driven down to stable load bearing stratum 18. Additional lengths of pier shaft may be added to pier assembly 10 with additional collars 26 in order to enable the combined pier shaft to reach load bearing stratum 18.

Once combined pier shaft 16*a* and 16*b* has reach load bearing stratum 18, such that helical screws 22 extend into load bearing stratum 18, the motor that rotationally drives combined pier shaft 16*a* and 16*b* is removed. Bracket 30 is then placed onto the top portion of pier shaft 16 and anchored to building foundation 14. With the use of a hydraulic jack, building foundation 14 is then raised vertically with respect to pier assembly 10. Once building foundation 14 is raised to a desired height, bracket 30 is then anchored to pier shaft 16 such that bracket 30 cannot move vertically with respect to pier shaft 16.

Braces 12 and 13 are then attached to pier 16 and building foundation 14. With the attachment of braces 12 and 13, the construction of pier assembly 10 is complete. Hole 34 would then either be refilled with compacted dirt or concrete. The use of concrete is preferred as it provides additional mechanical stability to pier assembly 10 and foundation 14. FIG. 1 illustrates pier assembly 10 in its final assembled configuration.

Figure 2:
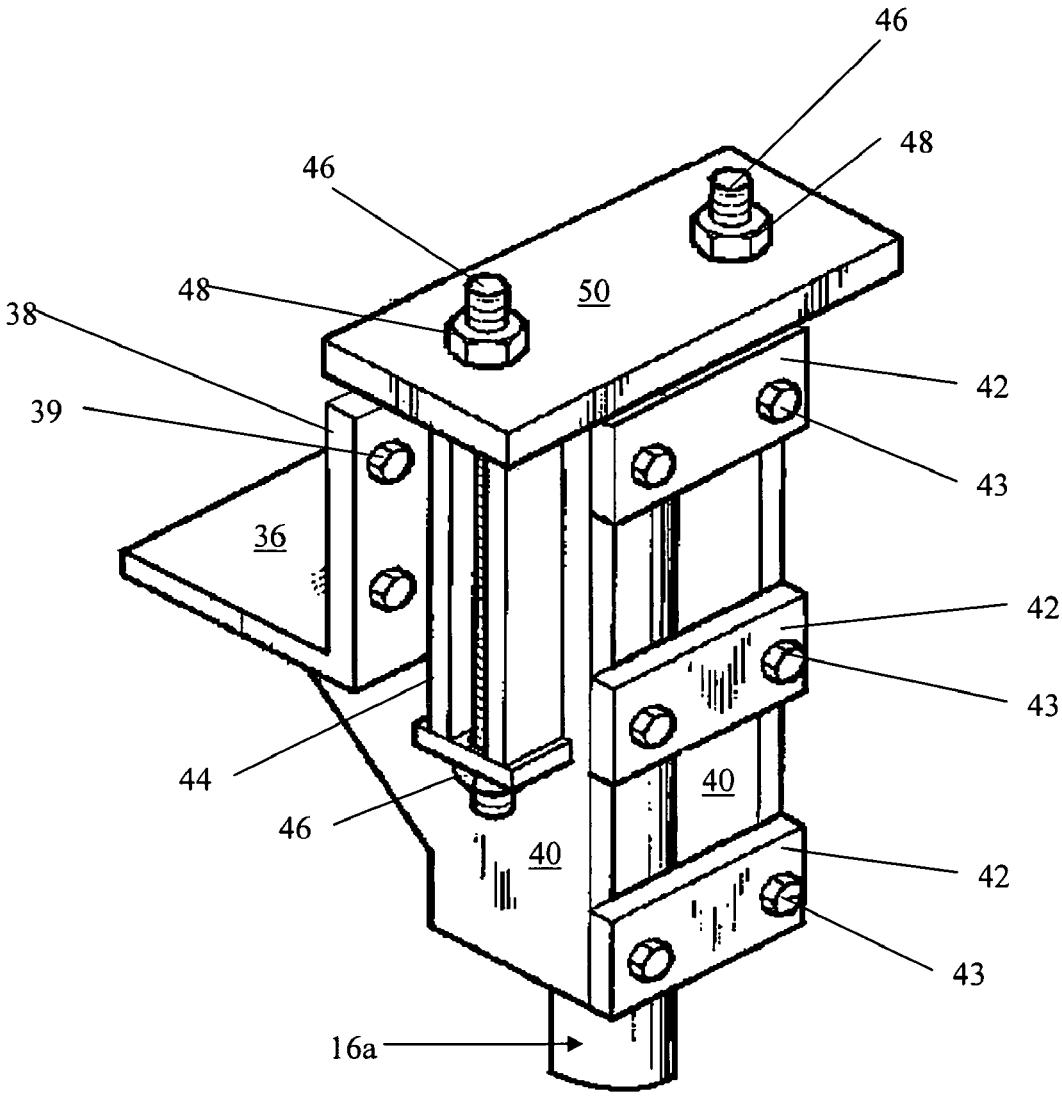
FIG. 2 depicts a bracket attached to a pier shaft forming a part of the pier assembly.

FIG. 2 depicts bracket 30 attached to pier shaft 16 forming a part of the pier assembly 10. A detailed description of an example of bracket 30 is provided in U.S. Pat. No. 6,193,442 issued to Donald R. May on Feb. 27, 2001, which is hereby incorporated by reference. Bracket 30 is "L" shaped and directly mounts to building foundation 14. "L" shaped bracket 30 is comprised of plate 36 that fits against the side of building foundation 14, plate 38 that extends under building foundation 14, bolts 39 that extend through plate 36 into building foundation 14, and two support plates 40. Support plates 40 provide mechanical support to plates 36 and 38. Support plates 40 combined with plate 36 form a "C" shaped channel in which pier shaft 16 resides. Rear plates 42 are bolted with bolts 43 onto the rear open portion of the "C" shaped channel formed by support plates 40 and plate 36. FIG. 2 illustrates three such rear plates 42. However, the illustration of three such rear plates 42 is merely exemplary and other numbers of rear plates 42, such as two or four may be used. Together, support plates 40, plate 36, and rear plates 42 form an enclosed channel that securely couples bracket 30 to pier 16.

A pair of connectors 44 is mounted to bracket 30. Connectors 44 allow threaded rods 46 and threaded nuts 48 to secure pier plate 50 to the rest of bracket 30. Pier plate 50 restricts the vertical motion of pier shaft 16 with respect to building foundation 14. Building foundation 14 rests upon plate 38. Pier plate 50 transfers the weight bearing load placed upon plate 38 onto pier shaft 16, thereby enabling bracket 30 to support building foundation 14 upon pier shaft 16.

Figure 3:
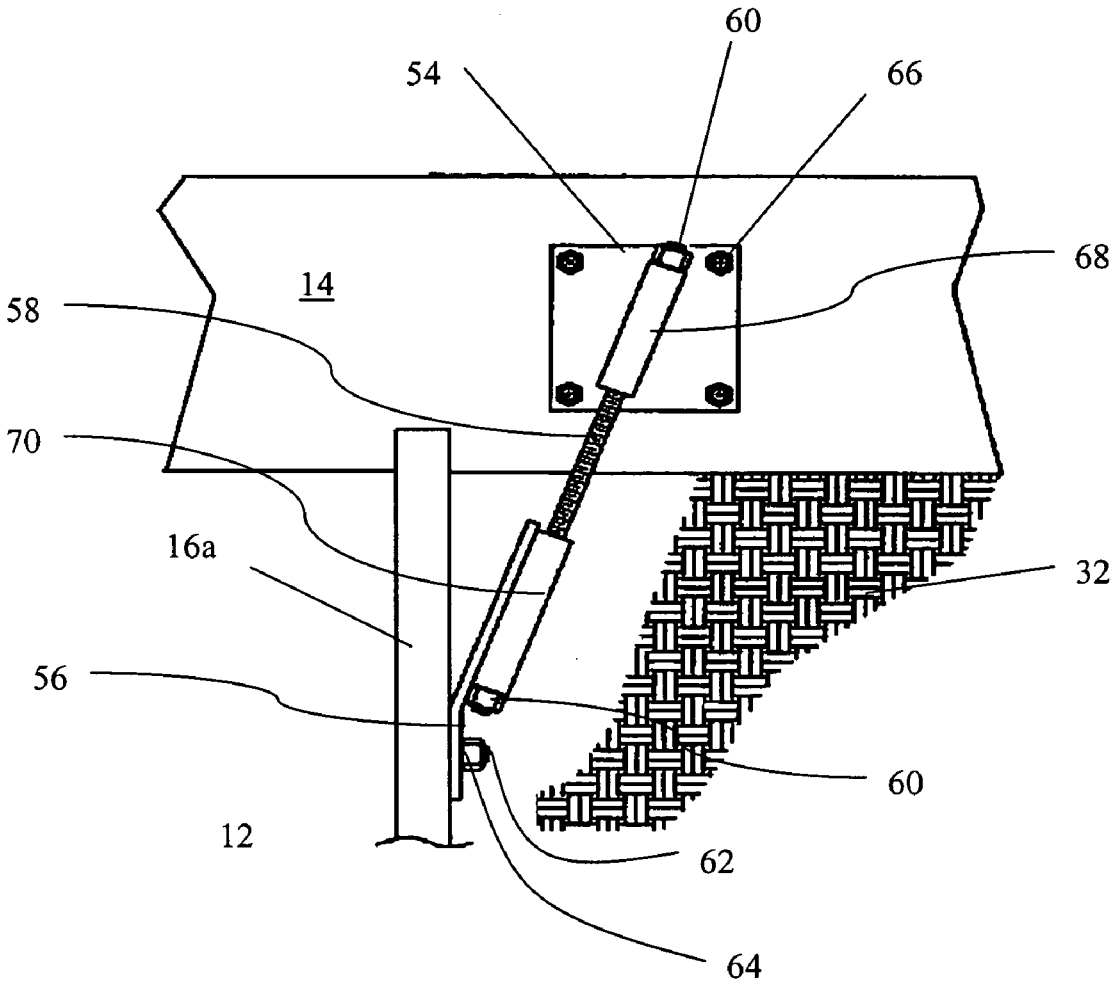
FIG. 3 depicts a brace attached to a pier shaft forming a part of the pier assembly.

FIG. 3 depicts right brace 12 attached to the right side of pier shaft 16 forming a part of pier assembly 10. For convenience, FIG. 3 does not depict bracket 30 that rests on the top portion of pier shaft 16 or left brace 13 that mounts to the left side of pier shaft 16. Right brace 12 includes a foundation plate mount 54, a pier shaft plate mount 56, a threaded rod 58, threaded nuts 60, bolt 62, nut 64, bolts 66, and cylinders 68 and 70. Bolts 66 mount foundation plate mount 54 to the foundation. Bolt 62 extends through pier shaft plate mount 56 to secure plate shaft mount 56 to pier shaft 16. Threaded cylinders 68 and 70 are mounted to foundation plate mount 54 and pier shaft plate mount 56 respectively. Cylinders 68 and 70 are axially aligned so that threaded rod 58 may extend through both cylinders 68 and 70. Threaded nuts 60 are attached to the ends of threaded rod 58 to further secure pier shaft 16 to building foundation 14.

The configuration of braces 12 and 13 is flexible to allow braces 12 and 13 to attach pier shaft 16 to differing building foundations 14. Further, when mounting braces 12 and 13, it may be required to mount them in a manner that avoids various obstructions on building foundation 14 such as water pipes, gas pipes, gas and electrical meters, electrical outlets and cables, and the like. Also, building foundation 14 may have damage such as cracks, which are desirable to avoid when mounting braces 12 and 13. One point of flexibility possessed by braces 12 and 13 is the length of threaded rod 58. Threaded rod 58 may be shortened or lengthened in order to secure pier shaft 16 to building foundation 14 at a desirable location while avoiding various obstructions on building foundation 14. Additionally, pier shaft plate mount 56 may be bent at varying angles. The combination of the ability to vary the length of threaded rod 58 and vary the mounting angle of braces 12 and 13 with respect to pier shaft 16 by bending pier shaft plate mount 56 enable braces 12 and 13 to be mounted at any position on building foundation 14.

Left brace 13 is the mirror image of right pier brace 12. Together, right and left braces 12 and 13 function to enhance the structural integrity of the attachment of pier assembly 10 to building foundation 14, thereby enhancing the ability of pier assembly 10 to better withstand lateral and vertical movement of ground 32.

Figure 4:
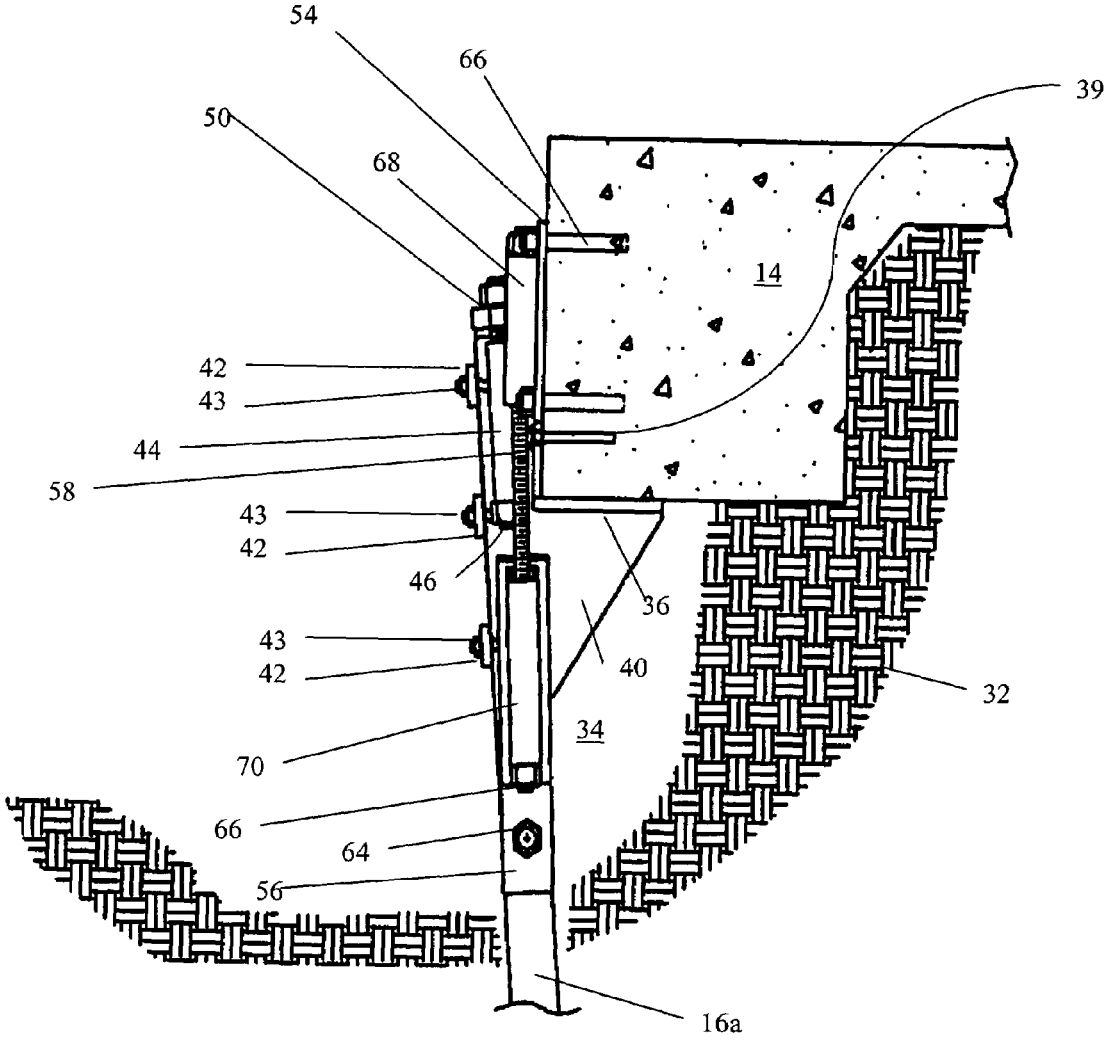
FIG. 4 depicts a side view of a pier assembly having braces supporting a building foundation.

FIG. 4 depicts a side view of pier shaft 16 having bracket 30 and braces 12 and 13 supporting a building foundation 14. Hole 34 is excavated around foundation 14 to facilitate the installation of pier assembly 10. Bracket 30 is mounted to building foundation 14 with bolts 39. Plate 36 extends under building foundation 14 so that building foundation 14 rests upon plate 36. Plate 38 rests against the side of building foundation 14.

Supporting plates 40 provide structural support to plates 36 and 38. Supporting plates 40, plates 36 and 38, along with rear plates 42 form a channel that securely holds pier shaft 16 within bracket 30. Pier plate 50 is mounted to the top of bracket 30 with threaded rods 46 and threaded nuts 48. Threaded rods are held in position by connectors 44 that are mounted to support plates 40.

Bolts 66 attach foundation plate mount 54 to foundation 14. Bolt 62 extends through pier shaft plate mount 56 to secure plate shaft mount 56 to pier shaft 16. Threaded cylinders 68 and 70 are attached to foundation plate mount 54 and pier shaft plate mount 56 respectively. Cylinders 68 and 70 are axially aligned so that threaded rod 58 may extend through both cylinders 68 and 70. Threaded nuts 60 are attached to the ends of threaded rod 58 to further secure pier shaft 16 to building foundation 14.

Although the present invention has been described in detail, it will be apparent to those of skill in the art that the invention may be embodied in a variety of specific forms and that various changes, substitutions, and alterations can be made without departing from the spirit and scope of the invention. The described embodiments are only illustrative and not restrictive and the scope of the invention is, therefore, indicated by the following claims.

I claim:

1. A pier for supporting a foundation, comprising:
- a pier shaft;
- a bracket that couples a top end of said pier shaft, said bracket supporting said foundation; and
- a first brace extending between a side of said pier and said foundation, said first brace attaches to said foundation at a position adjacent to said bracket, the first brace comprises a threaded rod attached to a foundation plate, wherein the foundation plate is movable along the lenght of the threaded rod until it is secured to said foundation.

2. The pier of claim 1, further comprising a second brace attached to said pier.

3. The pier of claim 2, said first and second braces attaching to opposite sides of said pier.

4. The pier of claim 3, said first and said second brace each comprising:
- a foundation plate mounted to said foundation;
- a pier shaft mount attached to said pier shaft; and
- a rod extending between said foundation plate and said pier shaft.

5. The pier of claim 4, said first and second brace further comprising a bolt that extends through each said pier shaft mount to secure said first and second brace to said pier shaft.

6. The pier of claim 1, said pier shaft has a helix formed near a lower end.

7. The pier of claim 1, said brace laterally supports said pier shaft with respect to said foundation.

8. The pier of claim 1, said brace restrains said pier shaft from moving vertically with respect to said foundation.

9. A structure for supporting a building foundation, comprising:
- a pier assembly comprising:
  - a pier shaft; and
  - a bracket mounted to a top portion of said pier shaft; and
  - a brace having first and second ends and an adjustable length, said first end attached at a non-zero angle to said pier assembly and said second end attached to said building foundation.

10. The structure of claim 9, said brace comprising:
- a foundation plate mounted to said foundation;
- a pier shaft mount attached to said pier assembly; and
- a rod extending between said foundation plate and said pier shaft.

11. The structure of claim 9, said second end of said brace attaches to said building foundation at a position adjacent to said bracket, said brace comprises a threaded rod attached to a foundation plate, the foundation plate may be moved along the lenght of the threaded rod until it is secured to the foundation.

12. The structure of claim 9, said pier shaft has a helix formed near a lower end.

13. The structure of claim 9, further comprising a second brace.

14. The structure of claim 13, said first and second braces attach to opposite sides of said pier assembly.

15. A structure for supporting a foundation, comprising:
- a pier shaft;
- a helix formed at a lower end of said pier shaft; and
- a pair of braces extending at an angle from opposite sides of said pier shaft and configured to attach at different positions to said foundation, each brace of said pair comprising:
- a foundation plate mounted to said foundation;
- a pier shaft mount attached to said pier shaft; and
- a rod extending between said foundation plate and said pier shaft.

16. The structure of claim 15, said braces attach to the side of said foundation.

17. The structure of claim 15, said braces laterally support said pier shaft with respect to said foundation.

18. The structure of claim 15, said braces restrain said pier shaft from moving vertically with respect to said foundation.

19. The structure of claim 15, further comprising a bracket mounted to a top end of said pier shaft.

* * * * *